US007997872B2

(12) United States Patent
Wilson

(10) Patent No.: US 7,997,872 B2
(45) Date of Patent: Aug. 16, 2011

(54) FAN BLADE

(75) Inventor: Mark J. Wilson, Nottinghamshire (GB)

(73) Assignee: Rolls-Royce PLC, London (GB)

( * ) Notice: Subject to any disclaimer, the term of this patent is extended or adjusted under 35 U.S.C. 154(b) by 967 days.

(21) Appl. No.: 11/907,804

(22) Filed: Oct. 17, 2007

(65) Prior Publication Data

US 2008/0095633 A1 Apr. 24, 2008

(30) Foreign Application Priority Data

Oct. 19, 2006 (GB) ..... 0620769.0

(51) Int. Cl.
*F01D 5/14* (2006.01)

(52) U.S. Cl. ..... 416/223 R; 416/223 A; 416/238; 416/243

(58) Field of Classification Search ..... 416/223 R, 416/223 A, 238, 243
See application file for complete search history.

(56) References Cited

U.S. PATENT DOCUMENTS

| | | | | |
|---|---|---|---|---|
| 3,400,912 | A * | 9/1968 | Carta et al. | 416/220 R |
| 3,820,918 | A * | 6/1974 | Goldstein | 416/223 R |
| 4,123,196 | A * | 10/1978 | Prince et al. | 415/181 |
| 4,408,957 | A * | 10/1983 | Kurzrock et al. | 416/237 |
| 4,732,532 | A | 3/1988 | Schwaller et al. | |
| 5,554,000 | A | 9/1996 | Katoh et al. | |
| 6,004,095 | A * | 12/1999 | Waitz et al. | 415/119 |
| 6,071,077 | A | 6/2000 | Rowlands | |
| 6,328,533 | B1 * | 12/2001 | Decker et al. | 416/228 |
| 6,338,609 | B1 * | 1/2002 | Decker et al. | 415/173.1 |
| RE38,040 | E | 3/2003 | Spear et al. | |
| 2005/0271513 | A1 | 12/2005 | Johann | |
| 2006/0029493 | A1 | 2/2006 | Schwaller et al. | |

FOREIGN PATENT DOCUMENTS

| | | | |
|---|---|---|---|
| EP | 1 533 529 | A2 | 5/2005 |
| EP | 1 571 342 | A2 | 9/2005 |
| EP | 1 712 738 | A2 | 10/2006 |
| JP | A-5-280495 | | 10/1993 |
| JP | A-8-121390 | | 5/1996 |
| RU | 2 188 340 | C1 | 8/2002 |
| WO | WO 2005088135 | A1 * | 9/2005 |

OTHER PUBLICATIONS

Jan. 30, 2008 Combined Search and Examination Report issued in British Patent Application No. GB0720329.2.
Oct. 14, 2009 Examination Report issued in British Application No. GB0720329.2.

* cited by examiner

*Primary Examiner* — Igor Kershteyn
(74) *Attorney, Agent, or Firm* — Oliff & Berridge, PLC

(57) ABSTRACT

The suction surface blade angle of a transonic fan blade, subject in use to a shock wave, progressively reduces along part of the suction surface, beginning at a position upstream of the shock wave position. The increased area variation at the location of the shock results in the shock position becoming less sensitive to small geometric imperfections. The reduced shock sensitivity reduces the variation in aerodynamic load and hence reduces the untwist variation with respect to small geometric imperfections. This has the effect of stabilising the untwist deflections of the fan.

11 Claims, 3 Drawing Sheets

FAN BLADE

FIELD OF INVENTION

This invention relates to fan blades for gas turbine engines, and more particularly to fan blades that in use operate in the transonic range.

BACKGROUND

The transonic range may be defined as the range of air speed in which both subsonic and supersonic airflow conditions exist around a body. It is largely dependent on the body shape, curvature and thickness-chord ratio, and can be broadly taken as Mach 0.8-1.4.

For simplicity, in this specification the terms "transonic fan" and "transonic fan blade" will be used to refer to a fan and a fan blade intended to operate substantially in the transonic range.

A significant proportion of the aerodynamic inefficiency of a transonic fan is due to the loss associated with the shock wave forming near the tip of the blade. A known way to reduce this loss is to design the suction surface of the blade, upstream of the shock wave position, with near-zero curvature. This minimises the expansion of the flow and thereby minimises the pre-shock Mach number.

In a conventional transonic fan, the covered passage formed by two adjacent blades first converges, before diverging further downstream. That is to say, the cross-sectional area of the first (upstream) part of the passage reduces, and the cross-sectional area of the later part of the passage increases.

However, the low curvature of the suction surface results in the flow area (the area of the passage normal to the flow) varying slowly in the vicinity of the shock wave, thereby causing the position of the shock to be very sensitive to small geometric imperfections in adjacent blades. The change in shock position causes a significant change in the untwist of the blades (the total deflection generated by the centrifugal and aerodynamic loads), which in turn further changes the shock position. If the aerodynamic loads are sufficiently high and the structure sufficiently flexible, this feedback mechanism results in the nominal untwist deflections becoming unstable with respect to geometric variability.

Because the shock wave cannot sit in a converging passage, it must either sit ahead of the covered passage, or must "jump" into the diverging part of the passage. This large and sudden change in the shock position causes a correspondingly large change in the untwist of the blades, which in turn further changes the shock position, thus leading to instability.

It is therefore an object of the invention to provide a transonic fan blade in which the untwist behaviour is more stable with respect to small geometric imperfections.

SUMMARY

According to the invention, there is provided a fan blade according to the exemplary embodiments discussed below.

BRIEF DESCRIPTION OF THE DRAWINGS

An embodiment of the invention will now be described, by way of example, with reference to the following drawings in which.

DETAILED DESCRIPTION OF EMBODIMENTS

A significant proportion of the aerodynamic inefficiency of a transonic fan is due to the loss associated with the shock wave forming near the tip of the blade. A schematic diagram of the flow around the tip section of such a fan is shown in FIG. 1.

Figure 1:
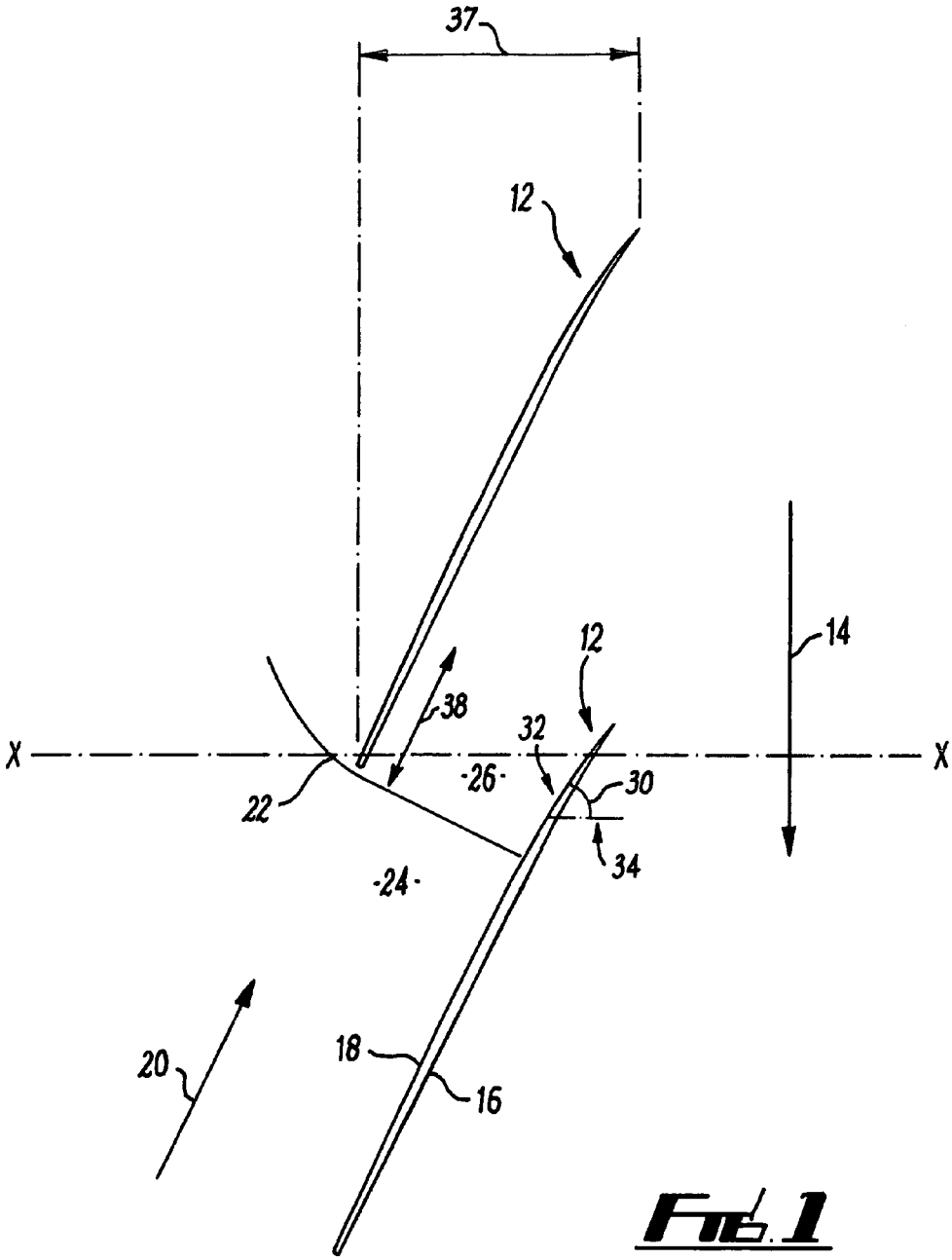
FIG. 1 is a schematic plan view of two adjacent fan blades, showing the position of a shock wave.

Two fan blades 12 are shown in FIG. 1. These are part of a set of fan blades, attached to and forming an annular array around a fan disc (not shown). In use, the fan disc rotates about the engine axis X-X, causing the fan blades 12 to move in the direction indicated by arrow 14. Each fan blade has a pressure surface 16 and a suction surface 18.

At any point on the suction surface 18, the suction surface angle 30 may be defined as the angle between the portion of the suction surface 32 at that point and the direction of the engine axis 34.

The axial chord of a blade is defined as the distance from the leading edge to the trailing edge of the blade in the direction of the engine axis X-X, as shown by the arrow 37.

In use, air flows into the flow passage between two adjacent fan blades 12 in the direction indicated by the arrow 20. In the region indicated by the double-headed arrow 38 the flow is bounded on each side by a blade surface (and, in and out of the plane of the paper, by the passage end walls). This region will be referred to as the covered passage. Under transonic conditions a shock wave 22 forms in approximately the position shown. Upstream of the shock wave 22, in the region 24, the local Mach number is greater than 1. Downstream of the shock wave 22, in the region 26, the local Mach number is less than 1.

The loss associated with the shock wave increases with increasing pre-shock Mach number, and therefore it is desirable, in designing transonic fans, to minimise the pre-shock Mach number. This may be achieved either by minimising the convex curvature of the suction surface upstream of the shock wave, thereby minimising the expansion of the flow, or by applying negative suction surface camber (concave curvature) ahead of the shock to compress the fluid and hence reduce the pre-shock Mach number.

The latter solution (negative suction surface camber) is generally less preferred, because of poor off-design performance considerations. More usually, therefore, the suction surface upstream of the shock wave of a transonic fan is designed with near zero curvature, as shown more clearly in FIG. 2. This graph shows the suction surface blade angle against distance along the blade chord.

In the region 42 of the fan blade, upstream of the shock wave position 44, it will be seen that the suction surface blade angle is substantially constant. Downstream of the shock wave position 44, in the region 46, the suction surface blade angle steadily reduces.

Efforts to reduce the weight and increase the efficiency of the gas turbine aircraft propulsion system tend to result in fan blades becoming increasingly thin and flexible. The deflections of the fan blades caused by the aerodynamic forces are particularly significant at low altitude, where these forces are higher. The non-linear characteristics of transonic flow mean that the deflections generated by the aerodynamic loads vary substantially between different operating points.

Small geometric differences between adjacent blades (resulting either from in-service wear or from manufacturing limitations) influence the position of the shock wave in the passage, and this in turn changes the aerodynamic load on each blade, changing the blades' untwist. The low curvature of the suction surface results in the flow area (the area of the passage normal to the flow) varying slowly in the vicinity of the shock wave, thereby causing the position of the shock to be very sensitive to small geometric imperfections in adjacent blades. The change in shock position causes a significant change in the untwist of the blades, which in turn further changes the shock position.

Because the shock wave cannot sit in a converging passage, it must either sit ahead of the covered passage, or must "jump" into the diverging part of the passage. This large and sudden change in the shock position causes a correspondingly large change in the untwist of the blades, which in turn further changes the shock position, thus leading to instability.

If the aerodynamic loads are sufficiently high and the structure sufficiently flexible, this feedback mechanism results in the nominal untwist deflections becoming unstable with respect to geometric variability. The adjacent blades untwist to secondary stable equilibrium deflections, which cause the shock to move into a stable region of greater flow area variation.

This unstable untwist behaviour causes high levels of passage-to-passage flow variability which has been shown to be detrimental to the forced vibratory response levels of the fan. It also has the potential to increase the multiple pure tone noise levels of the fan as the induced blade-to-blade geometric variability is greater under running conditions than that measured under static conditions.

Figure 2:
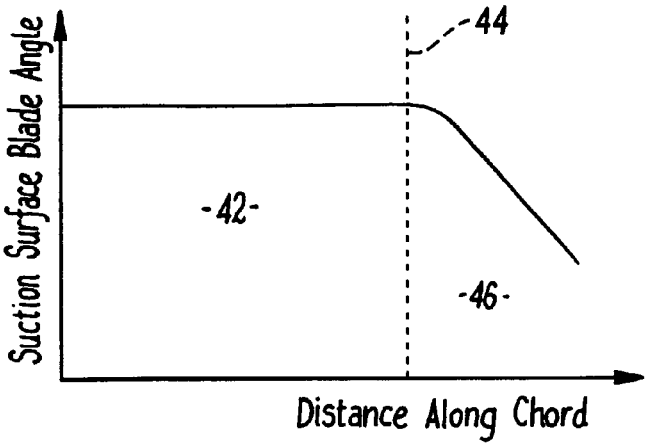
FIG. 2 is a graph of suction surface blade angle against distance along blade chord for a known fan blade.
Figure 3:
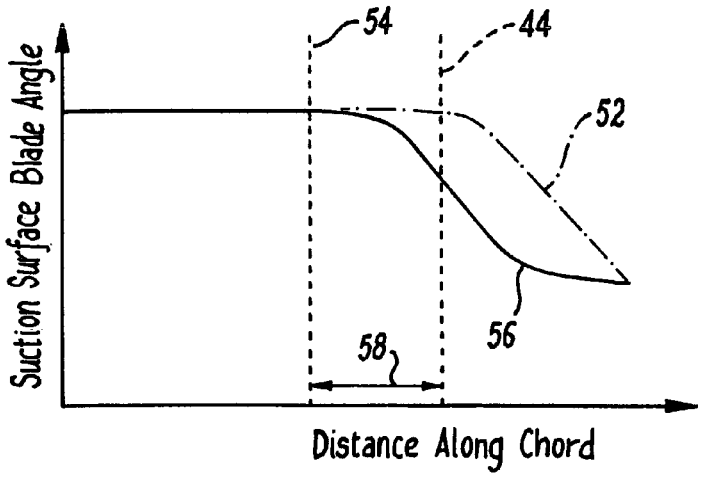
FIG. 3 is a graph of suction surface blade angle against distance along blade chord for a fan blade according to the invention.

The instability of the nominal untwist equilibrium, described above, arises out of the design of the suction surface of the transonic blade. This invention proposes a new profile of the suction surface to stabilise the nominal untwist, thereby providing a means to control the forced response and noise emission of the fan. To stabilise the untwist of the fan, the flow area variation at the shock position is increased. This is done by reducing the suction surface blade angle upstream of the shock position, thereby introducing camber into the blade. This is shown in FIG. 3, which may be compared directly with FIG. 2. The blade profile of FIG. 2 is reproduced as a dotted line 52 in FIG. 3, to illustrate the invention more clearly.

At a point 54, upstream of the shock wave position 44, the suction surface blade angle begins to reduce. This steady reduction in suction surface blade angle continues through the shock wave position 44 until a point 56, at which the suction surface blade angle "levels out" again. The distance 58 between the shock wave position 44 and the point 54 is around 17-18% of the axial chord of the fan blade.

In other preferred embodiments of the invention, the distance 58 may be between 15% and 20% of the axial chord of the fan blade. In further embodiments of the invention, the distance 58 may be between 10% and 25% of the axial chord of the fan blade.

The suction surface blade angle upstream of the point 54 is typically between 60° and 65°. The change in suction surface angle between the inlet and exit of the blade passage is typically around 10°, of which around 4° is upstream of the shock wave position 44. In other embodiments of the invention, the change in suction surface angle between the inlet and exit of the blade passage may be between 6° and 16°, respectively with between around 2.5° and around 6.5° upstream of the shock wave position 44.

The effect of these changes to the suction surface blade angle is that the cross-sectional area of the covered passage increases over its whole length, in contrast to the converging-diverging passage of a conventional transonic fan.

The increased area variation at the location of the shock results in the shock position becoming less sensitive to small geometric imperfections. The reduced shock sensitivity reduces the variation in aerodynamic load and hence reduces the untwist variation with respect to small geometric imperfections. This has the effect of stabilising the untwist deflections of the fan.

Because there is no longer a converging region at the upstream end of the covered passage, the shock wave is able to move smoothly from the position shown in FIG. 1, into and out of the covered passage, without the large jumps in shock wave position characteristic of a conventional transonic fan. Because the shock wave position is moving more smoothly, the changes in the blade untwist are correspondingly smoother. These smaller and more progressive movements of the shock wave position and the blade untwist prevent the cycle of instability that arises in conventional transonic fans when a large change in the shock wave position causes a large change in untwist, causing a further large change in the shock wave position.

The profile shown in FIG. 3 is an embodiment of the invention applied to a conventionally designed blade with zero or near zero suction surface curvature ahead of the shock wave (as shown in FIG. 2). However, the invention could equally be applied to a blade profile with negative suction surface curvature (pre-compression) ahead of the shock wave.

Figure 4:
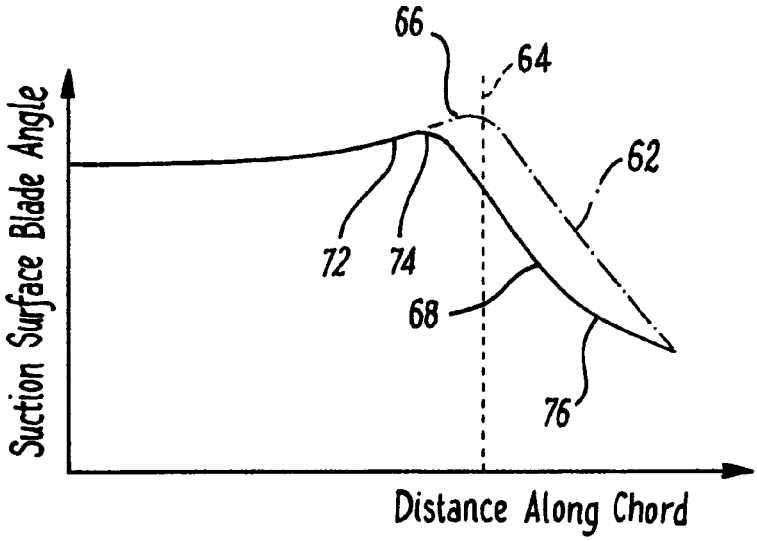
FIG. 4 is a graph of suction surface blade angle against distance along blade chord for a fan blade according to the invention.

Such a profile is shown in FIG. 4. The blade profile of a conventional blade with negative suction surface curvature is shown by the dotted line 62, for reference. The negative suction surface curvature, upstream of the shock wave position 64, is clearly seen at 66.

A blade according to the invention has a profile as shown by the solid line 68. There is still negative suction surface curvature upstream of the shock wave position 64, as shown at 72; then at a point 74, upstream of the shock wave position 64, the suction surface blade angle begins to reduce. This steady reduction in suction surface blade angle continues through the shock wave position 64 until a point 76, at which the suction surface blade angle "levels out" again.

Thus, as in the first embodiment, the increased area variation at the location of the shock results in the shock position becoming less sensitive to small geometric imperfections.

This invention stabilises the untwist equilibrium of a flexible transonic fan under high aerodynamic load through a novel suction surface design. The main result of this is that the stable system allows the running untwist of the fan to be determined based on static measurements, for example during build. This allows the forced response of the fan to be evaluated and the pattern of blades optimised to minimise the response of the blades and hence increase life.

The multiple pure tone noise generated by the fan is also greatly influenced by the running blade-to-blade geometric variation. U.S. Pat. No. 4,732,532 and US Patent Application No. 2006/0029493 describe methods to re-pattern the fan blades to minimise buzz saw noise. It is crucial, therefore, that the geometry of the blades when running can be related to that of the static blades to minimise the buzz-saw noise. For a conventionally designed transonic blade, as shown in FIG. 1 and FIG. 2, the instability prevents such a relationship being derived.

This invention, by reducing the instability during running, allows the relationship between the geometry of the blades when running and the geometry of the blades when static to be defined, thereby allowing the fan to be optimised for buzz saw noise.

The invention claimed is:

1. A fan blade arrangement for a gas turbine engine, the arrangement comprising:

a first blade having a leading edge, a trailing edge and a suction surface extending between the leading edge and the trailing edge;

a second blade adjacent and generally parallel to the first blade;

a covered passage defined by the first blade and the second blade, wherein the blade arrangement is subject to an air flow generally parallel to the suction surface and in a direction generally from the leading edge towards the trailing edge, the air flow giving rise to a shock wave associated with the leading edge of the second fan blade, the shock wave impinging on the suction surface of the first blade at a shock wave position, and a suction surface blade angle of the first blade progressively reduces in a direction generally from the leading edge towards the trailing edge along part of the suction surface so that the cross-sectional area of the covered passage between the first and second fan blades increases over an entire length of the covered passage such that the shock wave can move smoothly into and out of the covered passage.

2. A fan blade as in claim 1, in which in use the position at which the suction surface blade angle begins to reduce is between 10% and 25% of axial chord upstream of the shock wave position.

3. A fan blade as in claim 2, in which in use the position at which the suction surface blade angle begins to reduce is between 15% and 20% of axial chord upstream of the shock wave position.

4. A fan blade as in claim 3, in which in use the position at which the suction surface blade angle begins to reduce is between 17% and 18% of axial chord upstream of the shock wave position.

5. A fan blade as claimed in claim 1, in which in use the suction surface blade angle is reduced by between 2.5 and 6.5 degrees in the region upstream of the shock wave position.

6. A fan blade as in claim 5, in which in use the suction surface blade angle is reduced by between 3.5 and 4.5 degrees in the region upstream of the shock wave position.

7. A fan blade as claimed in claim 1, in which in use the part of the suction surface over which the suction surface blade angle reduces ends downstream of the shock wave position.

8. A fan blade as claimed in claim 1, in which the suction surface has negative curvature upstream of the position at which the suction surface blade angle begins to reduce, so as to provide pre-compression of the air flow in use.

9. A fan blade as claimed in claim 1, the fan blade being a transonic fan blade.

10. A fan for a gas turbine engine, comprising a plurality of fan blades as claimed in claim 1.

11. A gas turbine engine including a fan as claimed in claim 1.

* * * * *